US005617658A

United States Patent [19]

Chen

[11] Patent Number: 5,617,658

[45] Date of Patent: Apr. 8, 1997

[54] CARROUSEL

[76] Inventor: Corrina Chen, 8F, No. 185, Yung Chi Road, Taipei, Taiwan

[21] Appl. No.: 562,135

[22] Filed: Nov. 22, 1995

[51] Int. Cl.[6] ..... G09F 19/08

[52] U.S. Cl. ..... 40/411; 446/236; 472/12; 472/29

[58] Field of Search ..... 40/411, 414, 415; 472/12, 28, 29, 43; 446/236, 238

[56] References Cited

U.S. PATENT DOCUMENTS

| | | | |
|---|---|---|---|
| 1,566,479 | 12/1925 | Horvath et al. | 472/12 X |
| 4,753,436 | 6/1988 | Sinclair | 472/12 X |
| 5,314,365 | 5/1994 | Chen | 472/29 X |
| 5,458,012 | 10/1995 | Liu | 40/411 X |
| 5,556,318 | 9/1996 | So | 446/236 |

*Primary Examiner*—Brian K. Green
*Attorney, Agent, or Firm*—Pro-Techtor International

[57] ABSTRACT

A carrousel including a hollow base covered with a bottom cover, the bottom cover having an endless, wave-like track at a top side around the center, a rotary table supported on the bottom cover and turned on its center, the rotary table having a plurality of equiangularly spaced through holes around the border, a drive mounted on the bottom cover inside the hollow base and controlled to turn the rotary table on its center, a plurality of sleeves respectively mounted in the through hole of the rotary table, and a plurality of tappet rods respectively and slidably inserted into the sleeves and movably supported on the endless, wave-like track to carry a respective ornament above the rotary table.

3 Claims, 3 Drawing Sheets

CARROUSEL

BACKGROUND OF THE INVENTION

The present invention relates to music toys, and relates more particularly to a carrousel in which ornaments are moved up and down when carried by a rotary table around to make a rotary motion, and a music reproducer means is turned on to play certain tunes when the ornaments are moved.

Various music box ornaments have been disclosed, and have appeared on the market. Exemplars of these music box ornaments are seen in U.S. Pat. Nos. 4,890,828; 4,939,944;5,081,899. These music box ornaments commonly use the pinned barrel of a music box to reciprocate one or two tappet rods and an ornament on each tappet rod. When the clockwork of the music box is wound up by a handle and then released, the pinned barrel of the music box is rotated against the metal comb to produce certain tunes, and at the same time the rotational energy of the pinned barrel is transmitted to the tappet rod through a transmission mechanism, causing the tappet rod to make a linear motion, and therefore the ornament is reciprocated. Because the ornament can only be reciprocated vertically when the music box is played, this type of music box ornament gives little attraction to consumers.

SUMMARY OF THE INVENTION

The present invention has been accomplished under the circumstances in view. According to one aspect of the present invention, the carrousel comprises a hollow base covered with a bottom cover, the bottom cover having an endless, wave-like track at a top side around the center, a rotary table supported on the bottom cover and turned on its center, the rotary table having a plurality of equiangularly spaced through hole around the border, drive means mounted on the bottom cover inside the hollow base and controlled to turn the rotary table on its center, a plurality of sleeves respectively mounted in the through hole of the rotary table, and a plurality of tappet rods respectively and slidably inserted into the sleeves and movably supported on the endless, wave-like track to carry a respective ornament above the rotary table. When the ornaments are carried by the rotary table to make a rotary motion, the tappet rods are forced by the endless, wave-like track to move the ornaments up and down. According to another aspect of the present invention, the drive means comprises a motor, a reducing gear train coupled to the motor, a driving gear turned by the reducing gear train, and a driven gear fixedly secured to the rotary table and meshed with the driving gear.

As an alternate form of the present invention, music box can be used and installed instead of the music reproducer means and the drive means for playing certain tunes and turning the rotary table.

DETAILED DESCRIPTION OF THE PREFERRED EMBODIMENT

Figure 1:
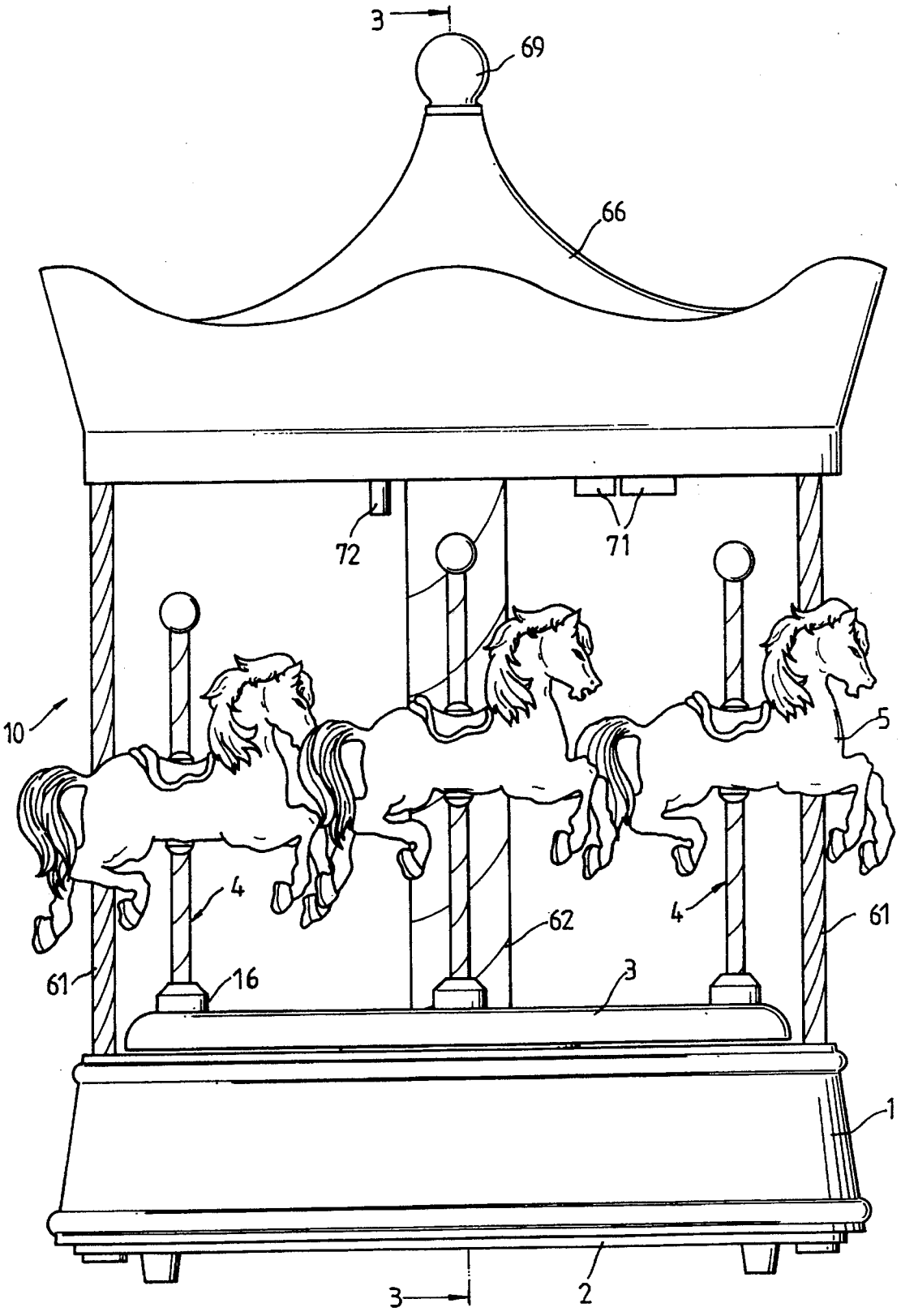
FIG. 1 is a front view of a carrousel according to the present invention.
Figure 2:
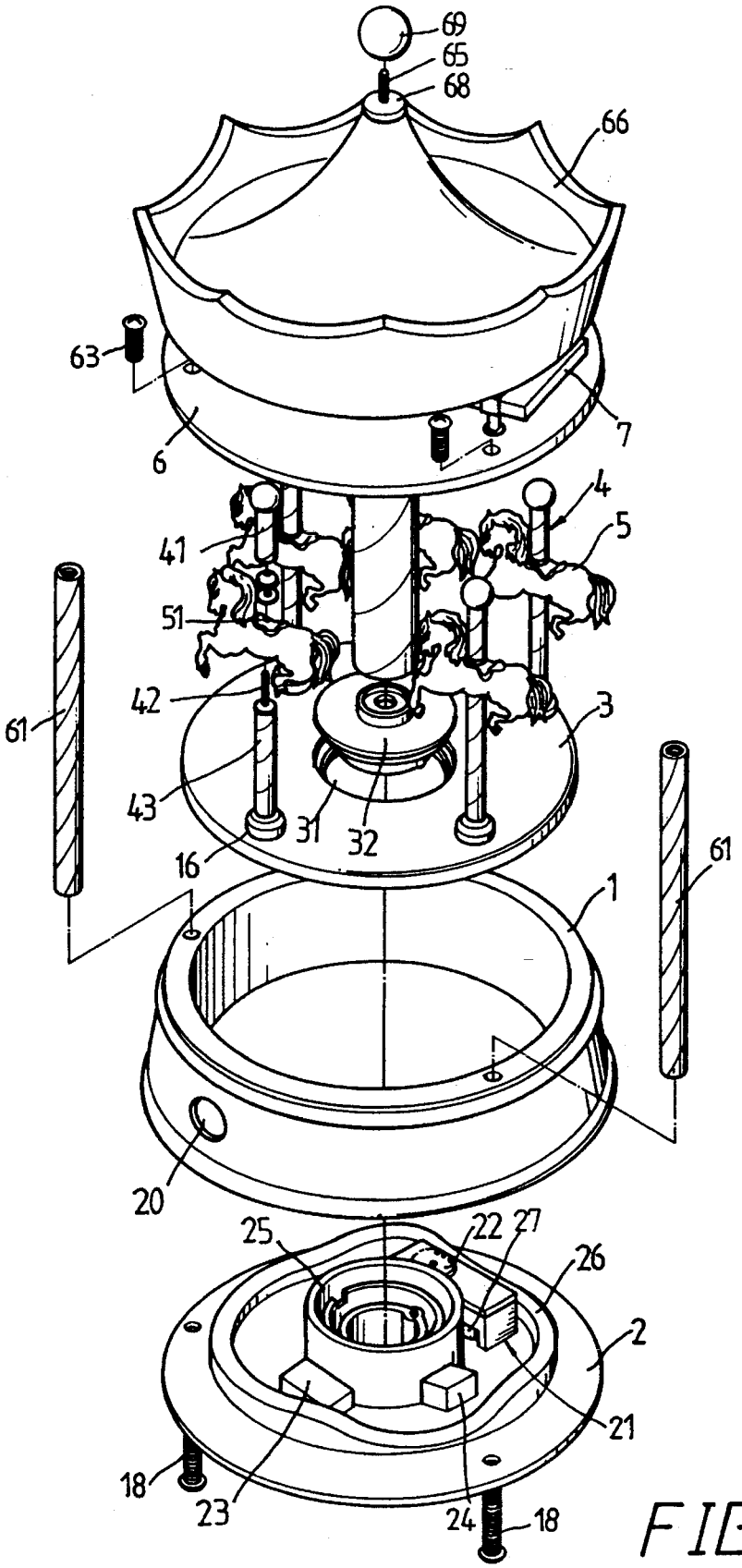
FIG. 2 is an exploded view of the carrousel shown in FIG. 1.
Figure 3:
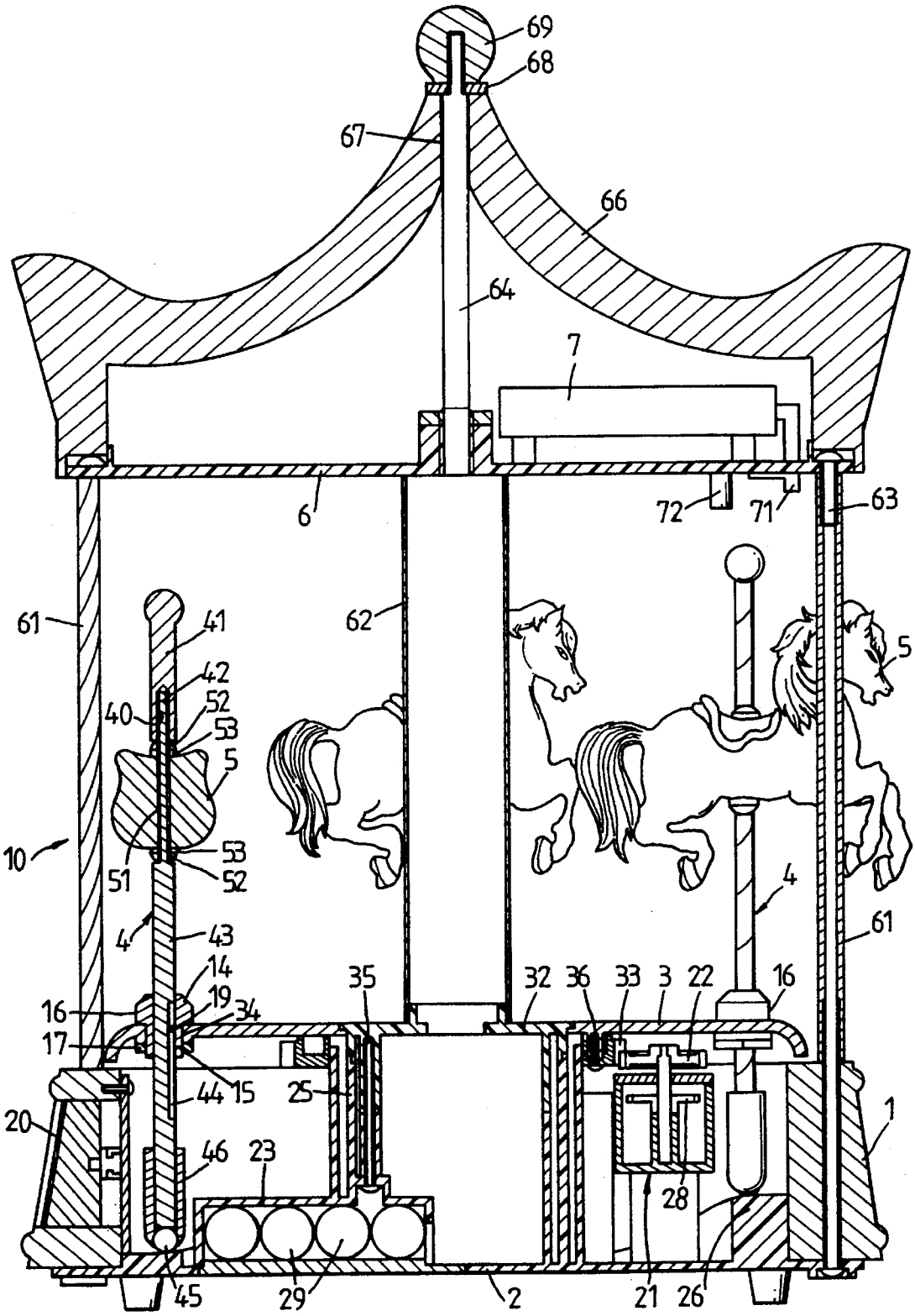
FIG. 3 is a sectional view along line 3—3 of FIG. 1 in an enlarged scale.

Referring to FIGS. 1, 2, and 3, the carrousel, referenced by 10, comprises a hollow base 1 having a bottom open end covered with a bottom cover 2. The bottom cover 2 is fixedly secured to the bottom side of the hollow base 1 by screws 18. A power drive 21 is mounted on the bottom cover 2 and disposed inside the hollow base 1. The power drive 21 comprises a motor 27, a reducing gear train 28 coupled to the motor 27, a driven gear 33, and a driving gear 22 meshed between the reducing gear train 28 and the driven gear 33. A rotary table 3 is fixedly secured to the driven gear 33 and revolvably disposed at the top side of the hollow base 1 in a horizontal position. When the motor 27 is started, the driven gear 33 is driven by the reducing gear train 28 through the driving gear 22 to turn the rotary table 3. A switch 20 is mounted on the outside wall of the hollow base 1 for controlling the operation of the motor 27. A battery box 23 is mounted on the bottom cover 2 and disposed inside the hollow base 1 to hold four pieces of "AA" battery cells 29. The battery cells 29 are electrically connected to the motor 27 through the switch 20. An electric adapter 24 is mounted on the bottom cover 2 for connection to AC power supply. The electric adapter 24 is connected to the motor 27 by an electric wire. The rotary table 3 has a center mounting hole 31. A bearing 32 is inserted through the center mounting hole 31 of the rotary table 3 and secured to a support 25 at the center of the bottom cover 2 by screws 35. When installed, the rotary table 3 can be turned by the driven gear 33 around the bearing 32. The driven gear 33 is fixedly secured to the rotary table 3 by screws 36, and meshed with the driving gear 22. A plurality of tappet rods 4 are equiangularly mounted on the rotary table 3. Each of the tappet rods 4 carries a respective ornament 5.

Referring to FIGS. 2 and 3 again, each of the tappet rods 4 comprises a bottom rod section 43, and a top rod section 41. The bottom rod section 43 has a screw rod 42 at the top end threaded into a bottom screw hole 40 on the top rod section 41. The ornament 5 has a through hole 51 for passing the screw rod 42 of the bottom rod section 43 of the respective tappet rod A cushion 53 is mounted around the screw rod 42 and stopped between the ornament 5 and the bottom rod section 43. A decorative cap 52 is mounted around the screw rod 42 and stopped between the ornament 5 and the top rod section 41. The bottom rod section 43 of each tappet rod 4 is slidably inserted into a respective sleeve 16. The sleeve 16 has an outer thread 15 and an outward top flange 14. When the sleeve 16 is inserted through a respective through hole 34 on the rotary table 3, the outward top flange 14 is stopped at the top side of the rotary table 3 above the respective through hole 34, and a nut 17 is threaded onto the outer thread 15 of the sleeve 16 from the bottom side (relative to the rotary table 3) to fix the sleeve 16 to the rotary table 3. The bottom rod section 43 of each tappet rod 4 has a longitudinal groove 44. The sleeve 16 has a raised portion 19 inserted into the longitudinal groove 44 of the bottom rod section 43 of the respective tappet rod 4 to limit the vertical reciprocating motion of the respective tappet rod 4. An endless, wave-like track 26 is integrally made on the top side of the bottom cover 2 and disposed in a concentric manner relative to the rotary table 3. The bottom rod sections 43 of the tappet rods 4 are respectively supported on the endless, wave-like track 26. When the rotary table 3 is rotated, the tappet rods 4 are moved up and down along the wave-like track 26, therefore the ornaments 4 are moved up and down when carried by the rotary table 3 around the bearing 32. In order to reduce the resisting force between the tappet rods 4 and the endless, wave-like track 26, the bottom end of the bottom rod section 43 of each tappet rod 4 is respectively mounted with a ball socket 46 to hold a ball 45, which is revolvably supported on the wave-like track 26.

Referring to FIGS. 1, 2, and 3 again, three upright posts 61 are equiangularly mounted on the topmost edge of the hollow base 1 around the rotary table 3 by the screws 18, which secure the bottom cover 2 to the hollow base 1. A tubular center support 62 is mounted on the bearing 32. A platform 6 is supported on the upright posts 61 and the tubular center support 62 at the top, and secured in place by screws 63. A music reproducer means 7 is mounted on the top side of the platform 6. A support 64 is mounted at the center of the platform 6 to support a shield 66. The support 64 has a screw rod 65 at the top (see FIG. 2) inserted through a center through hole 67 on the shield 66 and threaded into a decorative cap nut 69. A cushion 68 is mounted around the screw rod 65 and retained between the shield 66 and the cap nut 69. The aforesaid music reproducer means 7 and the power drive 21 use the same power source. Electric wire can be inserted through the tubular center support 62 and connected to the music reproducer means 7. Control keys 71 and volume regulator 72 are disposed at the bottom side of the platform 6 for controlling the operation of the music reproducer means 7.

A conventional music box may be used and installed to replace the aforesaid music reproducer means 7 and power drive 21. When a music box is used, the driving mechanism (clockwork) of the music box is coupled to the rotary table 3 so that the rotary table 3 is rotated when the music box reproduces certain tunes.

Referring to FIG. 3 again, when the switch 20 is switched on, the motor 27 is started to turn the driven gear 28 through the reducing gear train 21 via the driving gear 22, causing the driven gear 22 to turn the rotary table 3 around the bearing 32. When the tappet rods 4 are carried by the rotary table 3 around the bearing 32, they are simultaneously moved up and down along the wave-like track 26, at the same time the music reproducer means 7 is turned on to play certain tunes.

It is to be understood that the drawings are designed for purposes of illustration only, and are not intended as a definition of the limits and scope of the invention disclosed.

I claim:

1. A carousel comprising:

hollow base covered with a bottom cover, said bottom cover has a wave-like track formed directly on a top side around a center, a rotary table supported on said bottom cover, said rotary table has a plurality of equiangularly spaced through holes around a border, drive means mounted on said bottom cover inside said hollow base to drive said rotary table, a sleeve mounted in each of said plurality of equiangularly spaced through holes, a plurality of tappet rods inserted into said sleeves and movably supported on said wave-like track to support an ornament above said rotary table, a plurality of upright posts raised from said hollow base around said rotary table, a tubular center support raised from a center of said bottom cover, a platform supported on said upright posts and said tubular center support above said tappet rods, and a shield supported on an upright support on said platform such that said shield covers said platform.

2. The carrousel of claim 1 wherein: each of said plurality of tappet rods has a bottom end mounted with a ball socket and a ball, said ball is revolvably supported on said wave-like track.

3. The carousel of claim 1 further comprising:

a music reproducer means mounted on said platform and covered by said shield, and switch means disposed at a bottom side of said platform outside said shield to control said music reproducer means.

* * * * *